US006254741B1

(12) United States Patent
Stuart et al.

(10) Patent No.: US 6,254,741 B1
(45) Date of Patent: Jul. 3, 2001

(54) ELECTROLYTIC CELLS OF IMPROVED FLUID SEALABILITY

(75) Inventors: Andrew T. B. Stuart, Toronto; Raynald G. Lachance, Grand-Mere; Steven J. Thorpe, Toronto, all of (CA)

(73) Assignee: Stuart Energy Systems Corporation, Toronto (CA)

( * ) Notice: Subject to any disclaimer, the term of this patent is extended or adjusted under 35 U.S.C. 154(b) by 0 days.

(21) Appl. No.: 09/369,153

(22) Filed: Aug. 5, 1999

(51) Int. Cl.[7] ..... C25B 9/00

(52) U.S. Cl. ..... 204/254; 204/255; 204/263; 204/269; 429/34

(58) Field of Search ..... 204/269–270, 204/255–268, 253; 429/34, 38, 39

(56) References Cited

U.S. PATENT DOCUMENTS

| | | | | |
|---|---|---|---|---|
| 4,571,288 | | 2/1986 | Boulton . | |
| 4,605,482 | | 8/1986 | Shiragami et al. . | |
| 5,863,671 | * | 1/1999 | Spear, Jr. et al. | 429/12 |
| 6,080,290 | * | 6/2000 | Stuart et al. | 204/269 |

FOREIGN PATENT DOCUMENTS

| | | | | |
|---|---|---|---|---|
| WO 98/29912 | * | 7/1998 | (WO) | C25B/9/00 |

* cited by examiner

*Primary Examiner*—Robert Dawson
*Assistant Examiner*—Michael J. Feely
(74) *Attorney, Agent, or Firm*—Manelli Denison & Selter PLLC; Edward J. Stemberger

(57) ABSTRACT

An improved electrochemical system includes at least two cells. Each cell defines an anolyte chamber and a catholyte chamber, and includes at least an anode electrode adjacent to the anolyte chamber, and a cathode electrode adjacent to the catholyte chamber. At least one unitary one piece double electrode plate is provided having an electrically conducting frame. At least two single electrode plates are provided, each including an electrically conducting frame for supporting an anode electrode or a cathode electrode. A separator is between the catholyte and anolyte chambers and has at least a peripheral frame formed of a compressible elastomer. An anolyte chamber forming frame formed of a compressible elastomer and a catholyte chamber forming frame member formed of a compressible elastomer are provided within each cell. The anolyte and catholyte chamber forming frame members and the peripheral frame of the separator are compressed to form fluid tight seals when the electrochemical system is assembled. The anolyte and catholye chamber forming frame members extend beyond edges of the electronically conducting frames to allow of the peripheral frame being bonded in direct abutment with the anolyte and catholyte chamber forming frame members.

7 Claims, 12 Drawing Sheets

ELECTROLYTIC CELLS OF IMPROVED FLUID SEALABILITY

FIELD OF THE INVENTION

This invention relates to electrolytic cells, particularly to water electrolytic cells for the production of hydrogen and oxygen having improved gas and liquid sealability.

BACKGROUND TO THE INVENTION

Electrosynthesis is a method for production of chemical reaction(s) that is electrically driven by passage of an electric current, typically a direct current (DC), through an electrolyte between an anode electrode and a cathode electrode. An electrochemical cell is used for electrochemical reactions and comprises anode and cathode electrodes immersed in an electrolyte with the current passed between the electrodes from an external power source. The rate of production is proportional to the current flow in the absence of parasitic reactions. For example, in a liquid alkaline water electrolysis cell, the DC is passed between the two electrodes in an aqueous electrolyte to split water, the reactant, into component product gases, namely, hydrogen and oxygen where the product gases evolve at the surfaces of the respective electrodes.

Water electrolysers have typically relied on pressure control systems to control the pressure between the two halves of an electrolysis cell to insure that the two gases, namely, oxygen and hydrogen produced in the electrolytic reaction are kept separate and do not mix.

In the conventional mono-polar cell design presently in wide commercial use today, one cell or one array of (parallel) cells is contained within one functional electrolyser, or cell compartment, or individual tank. Therefore, each cell is made up of an assembly of electrode pairs in a separate tank where each assembly of electrode pairs connected in parallel acts as a single electrode pair. The connection to the cell is through a limited area contact using an interconnecting bus bar such as that disclosed in Canadian Patent No. 302,737, issued to A. T. Stuart (1930). The current is taken from a portion of a cathode in one cell to the anode of an adjacent cell using point-to-point electrical connections using the above-mentioned bus bar assembly between the cell compartments. The current is usually taken off one electrode at several points and the connection made to the next electrode at several points by means of bolting, welding or similar types of connections and each connection must be able to pass significant current densities.

Most filter press type electrolysers insulate the anodic and cathodic parts of the cell using a variety of materials that may include metals, plastics, rubbers, ceramics and various fibre based structures. In many cases, O-ring grooves are machined into frames or frames are moulded to allow O-rings to be inserted. Typically, at least two different materials from the assembly necessary to enclose the electrodes in the cell and create channels for electrolyte circulation, reactant feed and product removal.

WO98/29912, published Jul. 9, 1998, in the name The Electrolyser Corporation Ltd. and Stuart Energy Systems Inc., describes such an electrolyser system configured in either a series flow of current, single stack electrolyser (SSE) or in a parallel flow of current in a multiple stack electrolyser (MSE). Aforesaid WO98/29912 provides details of the components and assembly designs for both SSE and MSE electrolysers.

As used herein, the term "cell" or "electrochemical cell" refers to a structure comprising at least one pair of electrodes including an anode and a cathode with each being suitably supported within a cell stack configuration. The latter further comprises a series of components such as circulation frames/gaskets through which electrolyte is circulated and product is disengaged. The cell includes a separator assembly having appropriate means for sealing and mechanically supporting the separator within the enclosure and an end wall used to separate adjacent "cells". Multiple cells may be connected either in series or in parallel to form cell stacks and there is no limit on how many cells may be used to form a stack. In a stack the cells are connected in the same way, either in parallel or in series. A cell block is a unit that comprises one or more cell stacks and multiple cell blocks are connected together by an external bus bar. A functional electrolyser comprises one or more cells that are connected together either in parallel, in series, or a combination of both as detailed in PCT application WO98/29912.

Depending on the configuration of such a cell stack electrochemical system, each includes an end box at both ends of each stack in the simplest series configuration or a collection of end boxes attached at the end of each cell block. Alternative embodiments of an electrolyser includes end boxes adapted to be coupled to a horizontal header box when both a parallel and series combination of cells are assembled.

In the operation of the cell stack during electrolysis of the electrolyte, the anode serves to generate oxygen gas whereas the cathode serves to generate hydrogen gas. The two gases are kept separate and distinct by a low permeable membrane/separator. The flow of gases and electrolytes are conducted via circulation frames/gasket assemblies which also act to seal one cell component to a second and to contain the electrolyte in a cell stack configuration in analogy to a tank.

The rigid end boxes can serve several functions including providing a return channel for electrolyte flowing out from the top of the cell in addition to serving as a gas/liquid separation device. They may also provide a location for components used for controlling the electrolyte level, i.e. liquid level sensors and temperature, i.e. for example heaters, coolers or heat exchangers. In addition, with appropriate sensors in the end boxes individual cell stack electrolyte and gas purity may be monitored. Also, while most of the electrolyte is recirculated through the electrolyser, an electrolyte stream may be taken from each end box to provide external level control, electrolyte density, temperature, cell pressure and gas purity control and monitoring. This stream would be returned to either the same end box or nixed with other similar streams and returned to the end boxes. Alternatively, probes may be inserted into the end boxes to control these parameters.

The prior art cells generally comprise a plurality of planar members comprising metallic current carriers, separators, gaskets, and circulation frames suitably functionally ordered, and arranged adjacently one to another in gas and electrolyte solution sealed engagement with and between the end walls of the cell(s). The non-metallic components such as the gaskets, separators and circulation frames are formed of compressible elastomeric materials. Assembly of the cell by compression of the cell components together provides, generally, satisfactory fluid tight seals within the cell block. In prior art cells such as the MSE and SSE described in aforesaid WO98/29912, the metal current carriers which include the electrode members, per se, extend to the top, bottom and side edges of the cell, as do the non-metallic components, such that the peripheries of the elastomeric and metallic planar members are coplanar. While satisfactory, this cell construction is in need of improvement to enhance cell sealability where, particularly, KOH electrolyte leakage may be high undesirable.

There is, therefore, a need for a cell, cell stack and entire cell block assembly having improved fluid sealability.

SUMMARY OF THE INVENTION

It is an object of the present invention to provide an improved cell assembly which reduces or eliminates fluid leakage.

The invention provides an electrolyser, particularly, of the MSE or SSE type, wherein the circulation frames extend beyond the edges of the metallic current carriers such that a circulation frame and/or gasket of a first cell is formed of an elastomeric material compatible with the elastomeric material of a circulation frame and/or gasket of an adjacent second cell, which first and second cells comprise a cell stack or cell block; and wherein the circulation frames extend beyond the edges of the metallic current carriers whereby the circulation frames may be bonded directly to adjacent non-metallic separators. Thus, the first and second cells may be joined directly together without current carrier metallic/non-metallic frame intervening boundary edges. This eliminates the need to provide gaskets at this boundary.

This invention enables an entire cell block to be suitably encapsulated with elastomeric material to render the edges of the block to be hermetic and leak tight for both $O_2$ and $H_2$ gases and electrolyte.

The frame may be integrally formed.

Accordingly, the invention provides in one aspect, an improved electrochemical system, comprising (a) at least two cells, each cell defining an anolyte chamber and a catholyte chamber, and including at least an anode electrode adjacent to said anolyte chamber, and a cathode electrode adjacent to said catholyte chamber;

(b) at least one unitary one piece double electrode plate having an electrically conducting frame, the anode electrode in one of said at least two cells being supported on a first portion of said electrically conducting frame, and the cathode electrode in one of the other of said at least two cells being supported on a second portion of said electrically conducting frame spaced from said first portion;

(c) at least two single electrode plates, each single electrode plate including an electrically conducting frame for supporting an anode electrode or a cathode electrode wherein the first and second portions of the double electrode plate include at least opposed faces, each of the opposed faces including a substantially planar peripheral surface extending about a periphery of the supported anode and cathode electrodes, and wherein the electrically conducting frame of the single electrode plate includes opposed faces and a planar peripheral surface on each of the opposed faces extending about a periphery of the anode or cathode supported on the single electrode plate;

(d) a separator between the catholyte and anolyte chambers and having at least a peripheral frame formed of a compressible elastomer;

(e) an anolyte chamber forming frame formed of a compressible elastomer and a catholyte chamber forming frame member formed of a compressible elastomer within each cell, wherein said anolyte and catholyte forming frame members and the peripheral frame of the separator are compressed to form fluid tight seals when said electrochemical system is assembled, the improvement comprising said peripheral frame being bonded in direct abutment with said anolyte and catholyte chamber forming frame members.

By the term "direct abutment" when used in this specification and claims is meant the direct bonding of the peripheral frame with each of the anolyte and catholyte chamber forming frame members through adjacent interfacial touching or if the respective members do not actually touch when assembled are nonetheless in such close proximity one to another as to allow for suitable bonding by means of an adhesive compound, melting or other suitable means.

Thus, the present invention provides modifications to several of the aforesaid cell components to achieve encapsulation at all edges, namely, adjacent the top, bottom and sides of the cell, stack, block and the like by direct abutment of the planar components and, most preferably, by bonding/sealing of the elastomic polymer components one to another to reduce or prevent fluid, namely, hydrogen and oxygen gases and electrolyte solutions leakage. The bonding/sealing of the elastomeric materials may be achieved by thermal (melting), ultrasonic, solvating or adhesive bonding or combinations thereof The circulation frame extends beyond the metal carrier plates in a multi-cell and multi-cell stack, wherein all the carrier electrode plates are preferably shortened apart from the anode and cathode electrodes which constitute the terminus of the cell stack or block.

BRIEF DESCRIPTION OF THE DRAWINGS

In order that the invention may be better understood, preferred embodiments will now be described by way of example only, with reference to the accompanying drawings wherein.

DETAILED DESCRIPTION OF PREFERRED EMBODIMENTS

Figure 1:
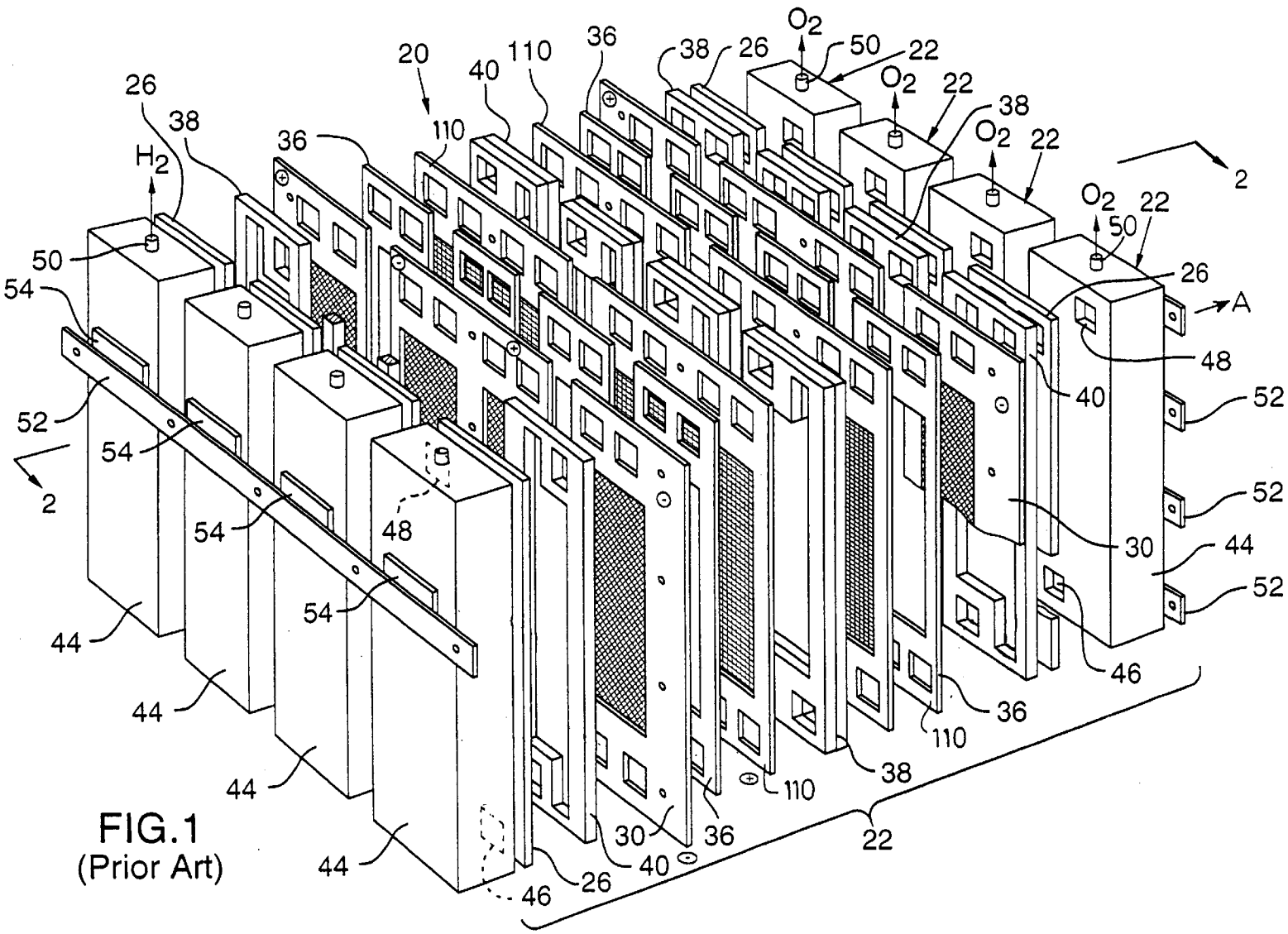
FIG. 1 (Prior Art)
FIG. 1 is an exploded perspective view of a multiple stack electrochemical system (MSE) consisting of the series connection of four stacks consisting of two cells each connected in parallel according to the prior art.

FIG. 1 shows generally as 20 a monopolar MSE according to the prior art as an embodiment in aforesaid WO98/29912.

Electrochemical system 20 is shown as a cell block comprising four cell stacks 22 with series connections between cell stacks and the two electrolysis cells of each stack connected in parallel.

Each stack 22 comprises two cells having two anodes 110 and two cathodes 30. In each compartment an anolyte frame 38 is located adjacent to anodes 110 to define an anolyte chamber and a catholyte frame 40 is located adjacent to cathodes 30 defining a catholyte chamber. Anolyte frame 38 is essentially identical in structure to catholyte frame 40 and may be generally referred to as electrolyte circulation frames.

Each anode and cathode chamber in a given cell is separated by a separator assembly 36 to reduce mixing of the different electrolysis products, namely oxygen and hydrogen, produced in the respective anode and cathode chambers.

Electrochemical system 20 includes an end box 44 at each end of each stack 22. Referring specially to FIG. 1, each end box 44 is provided with a lower aperture 46 and an upper aperture 48 in the side of the box in communication with the respective anolyte or catholyte chamber. A gas outlet 50 at the top of each box 44 provides an outlet for collecting the respective gas involved during the electrolysis reaction. Cell stacks 22 and entire cell block 20 are held together with sufficient force so that a fluid tight seal is made to prevent leaking of electrolyte or gases. The use of a rigid structural element such as a rectangular tube used to form end box 44 with clamping bars 52 and tie rods and associated fasteners (not shown) provides an even load distributing surface to seal the stacks 22 at modest clamping pressures. Electrically insulating panels 54 are sandwiched between the outer surfaces of end boxes 44 and clamping bars 52 in order to prevent the end boxes from being electrically connected to each other by the clamping bars.

An insulating planar gasket 26 is disposed at the end of each stack between electrolyte frames 38 or 40 and end boxes 44 for insulating the face of end box 44 from contact with electrolyte. Gasket 26 is provided with an upper aperture and a lower aperture (not shown) in registration with apertures 48 and 46, respectively, in end box 44 for fluid circulation.

Figure 2:
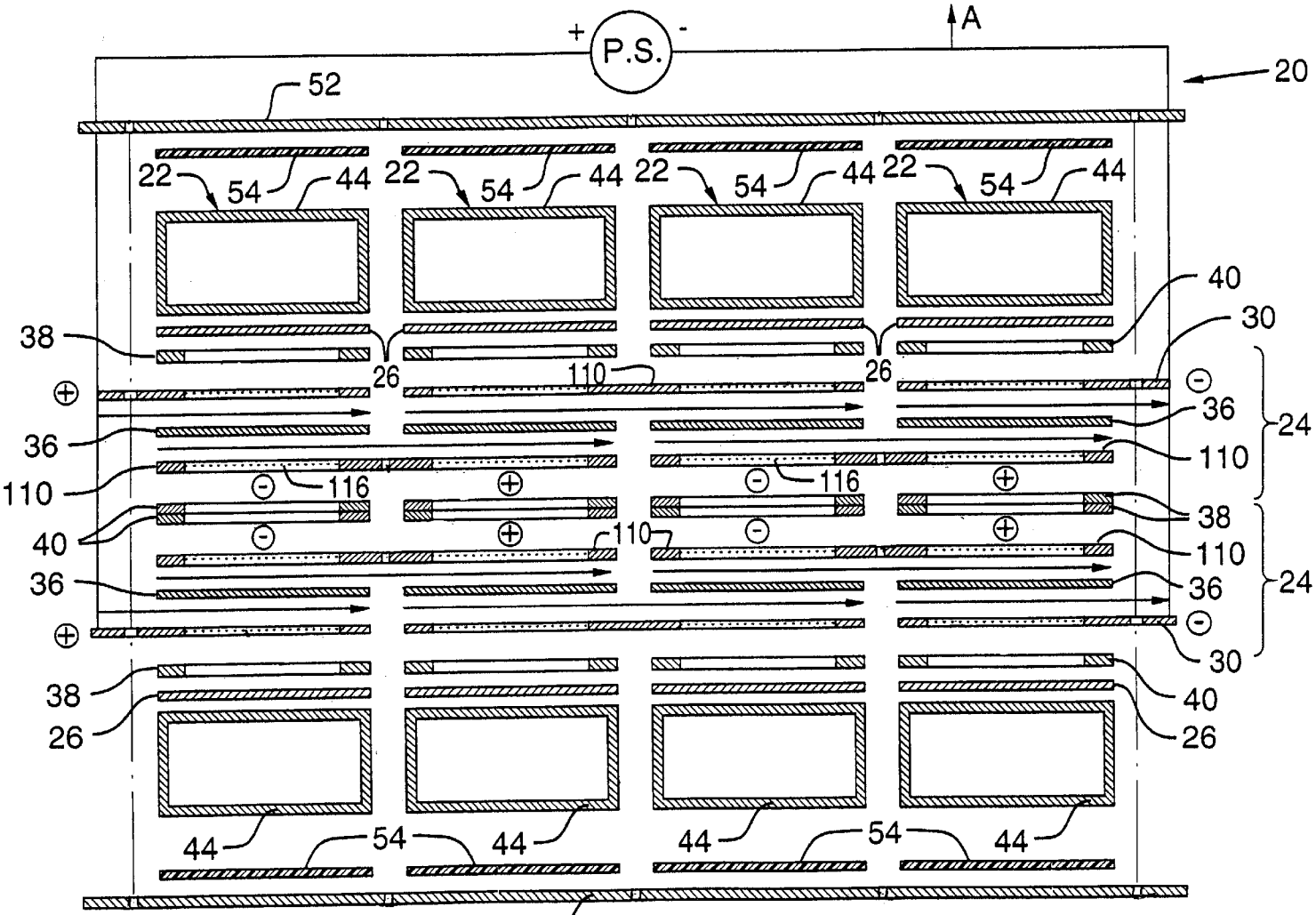
FIG.2 (Prior Art)
FIG. 2 is a horizontal cross section along line 2—2 of FIG. 1 showing the electric current path in the cell block.

With reference to FIG. 2, this shows each of the pair of metallic terminus double electrode plates (DEP)110 coterminous with its respective separator assembly 36 and anolyte frame 38, according to the prior art. Thus, bonding by merely lateral compression of the metallic to non-metallic components effects essentially satisfactory fluid sealing of these components. A similar arrangement is seen at the inner terminus of the DEP110.

Figure 3:
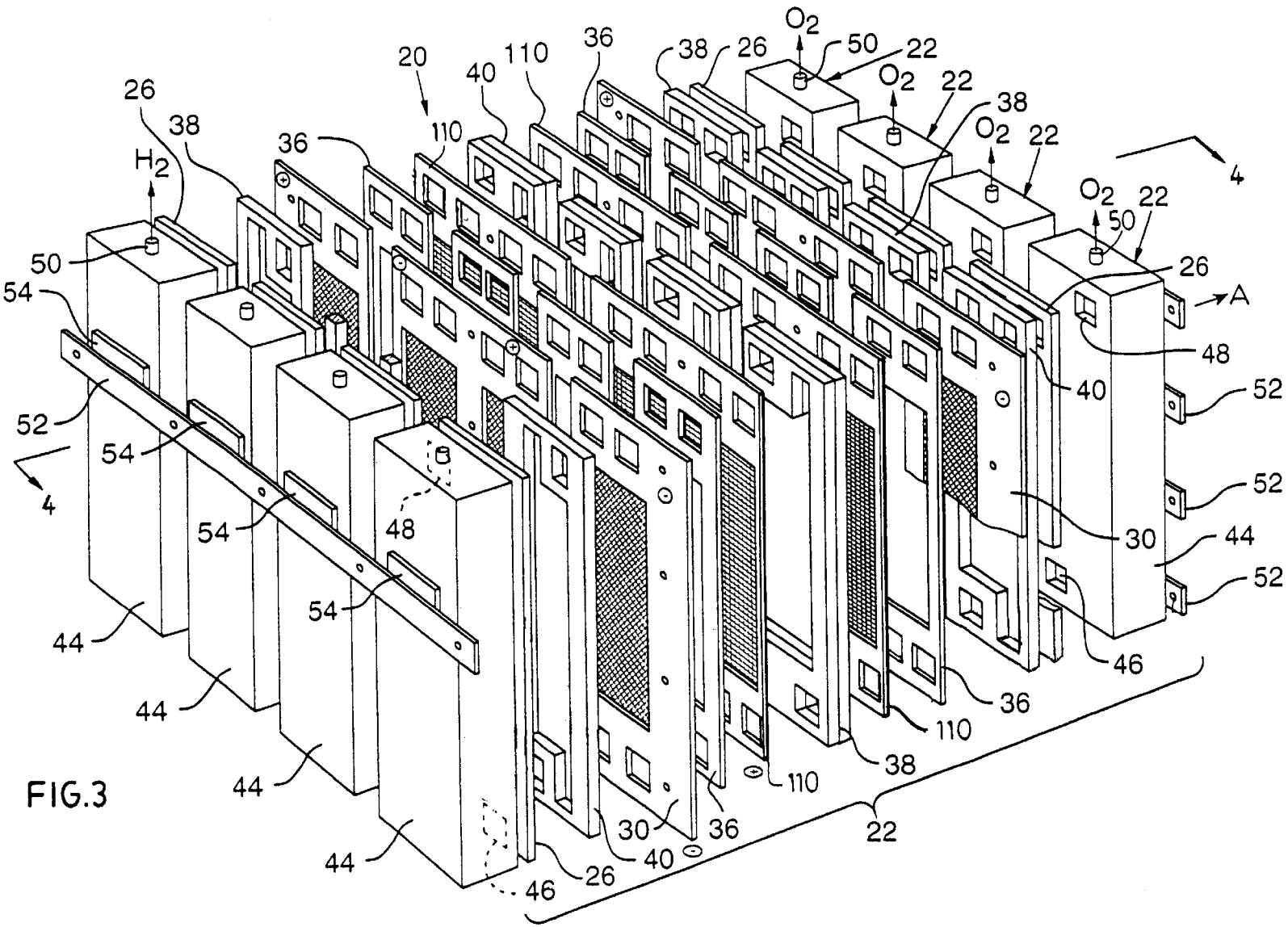
FIG. 3 is an exploded perspective view of a multiple stack electrochemical system (MSE) consisting of the series connection of four stacks consisting of two cells each connected in parallel according to the invention.
Figure 4:
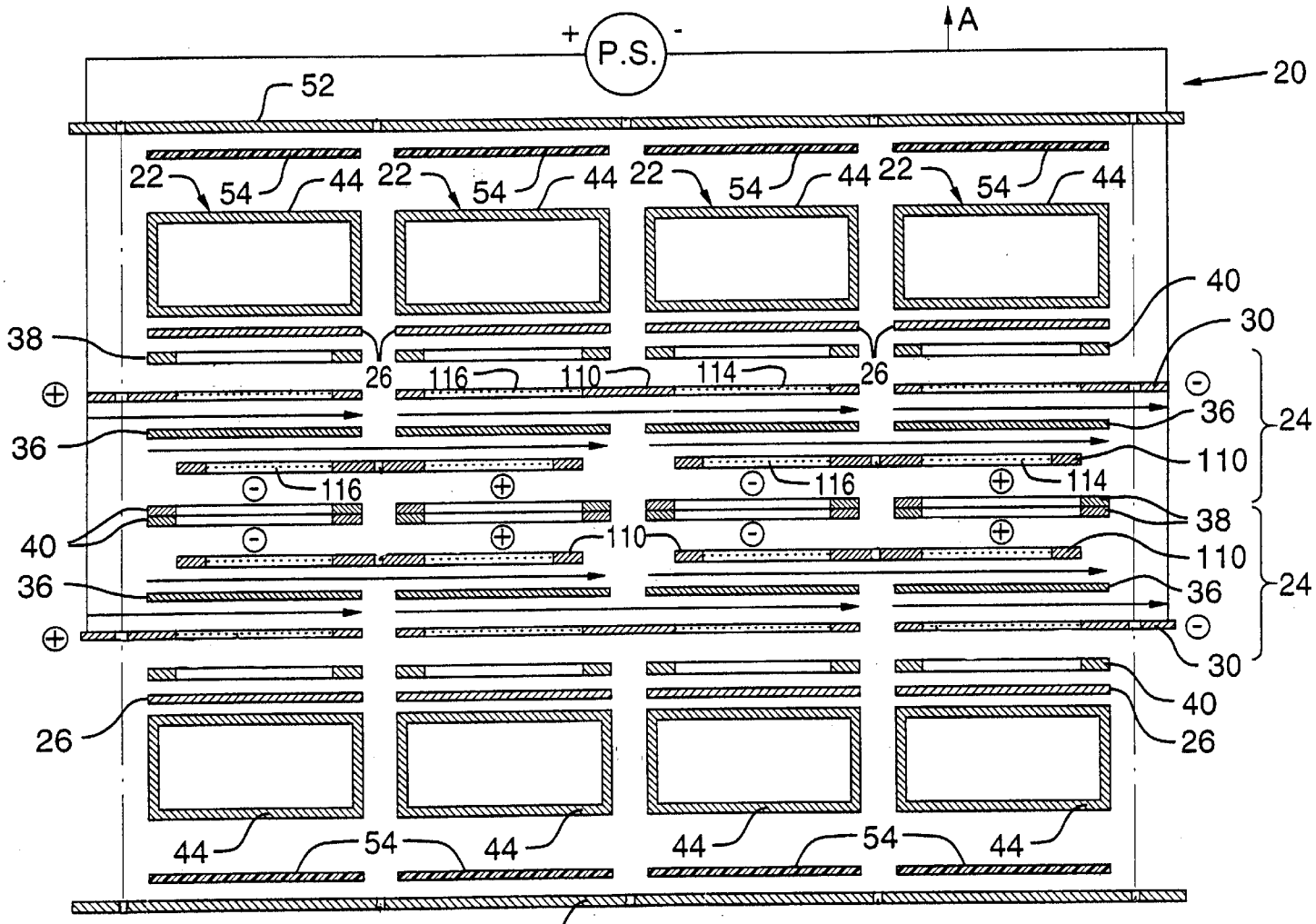
FIG. 4 is a horizontal cross section along line 4—4 of FIG. 3 showing the electric current path in the cell block according to the invention.

With reference now to FIGS. 3 and 4, according to the invention, it can be seen that DEP110 is shortened whereby the metallic terminus does not interpose between separator assembly 36, more specifically, the separator frame 62 (FIGS. 12*a* and 12*b*) thereof and anolyte frame 38 when the cell components are assembled under compression, whereby a satisfactory fluid tight bonding is effected. Preferably, separator frame 62 is bonded to the circulation frames by means of an adhesive, solvent, ultrasonic or thermal bonding. A similar arrangement is seen at the inner terminus of the DEP110/catholyte frame/separator assembly.

Figure 12A:
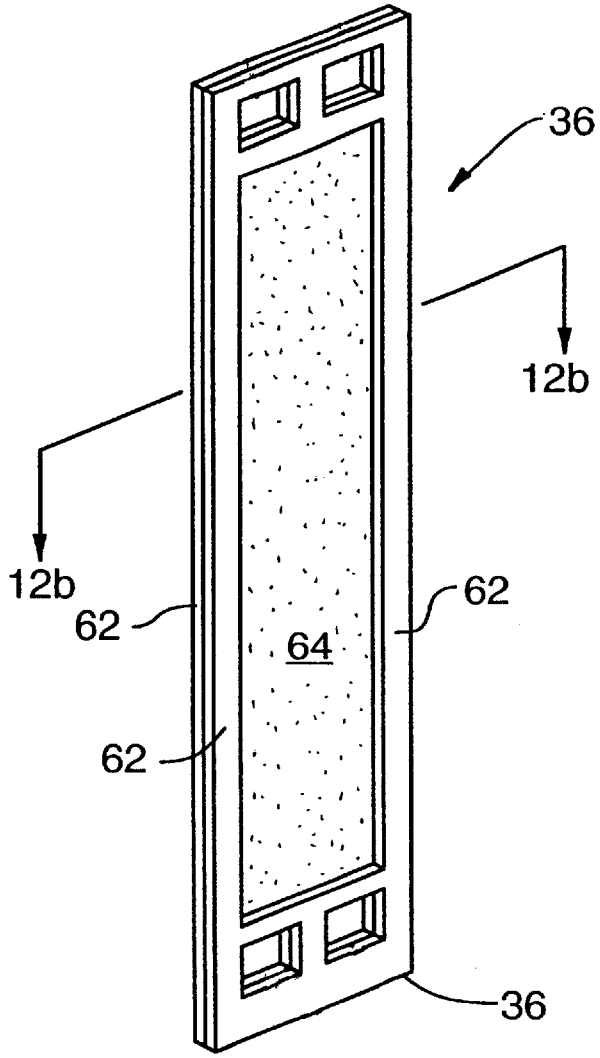
FIG.12A (Prior Art)
FIG. 12*a* is a perspective view of a gas separator assembly according to the prior art.
Figure 12B:
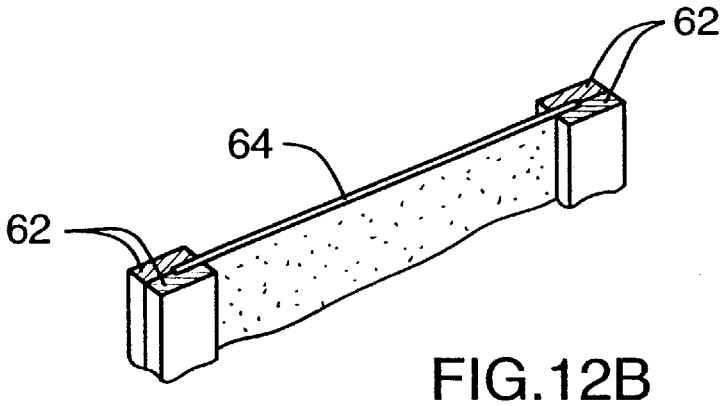
FIG. 12*b* is a view along the line 12*b*—12*b*; and wherein the same numerals denote like parts.

With reference to FIGS. 12*a* and 12*b*, these show a separator assembly generally as 36 consisting of a pair of identical peripheral elastomeric frames 62 welded or otherwise joined together with a separator membrane 64 sandwiched between the two frames 62.

Figure 5:
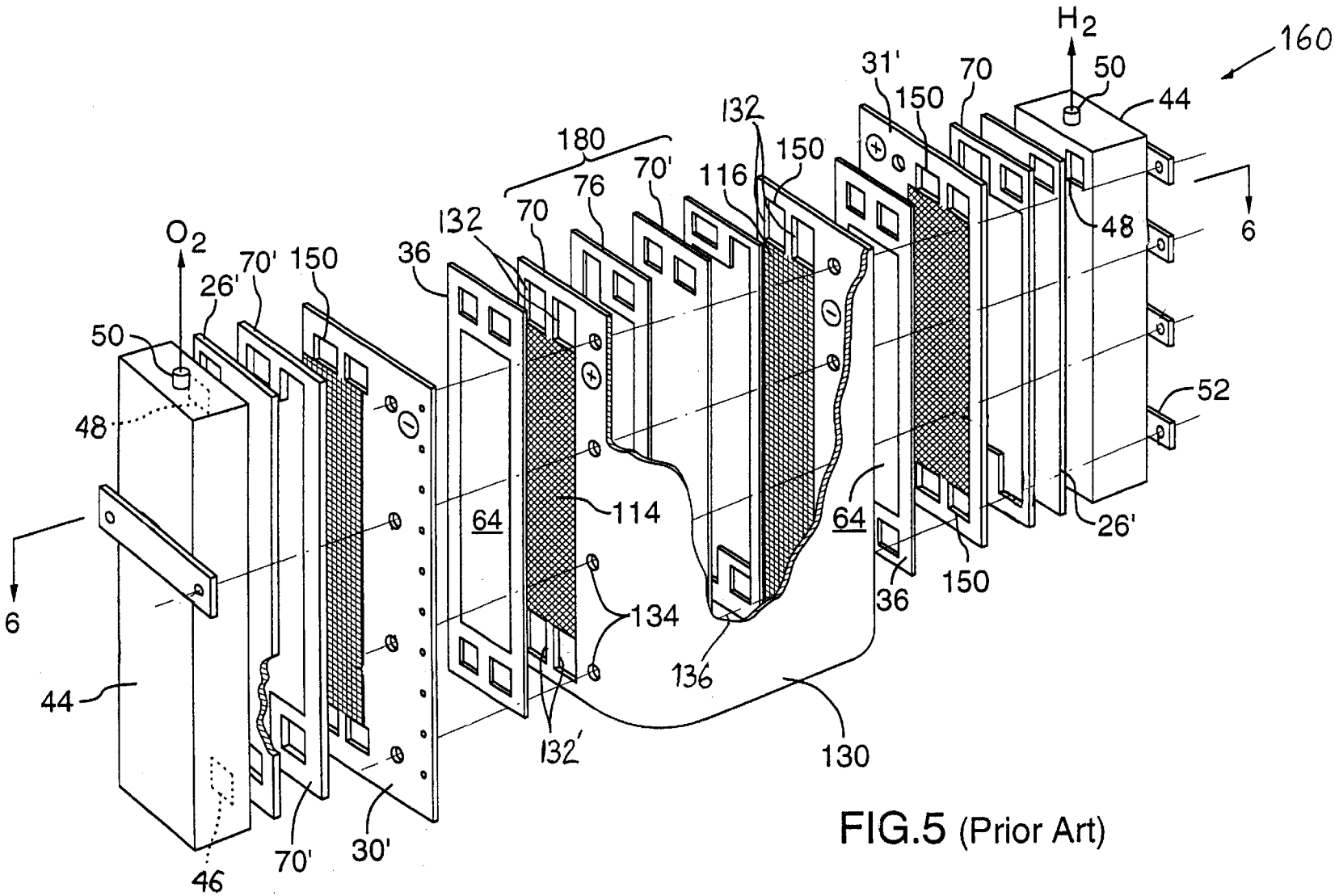
FIG.5 (Prior Art)
FIG. 5 is a perspective exploded view of a two cell single stack electrolyser (SSE) according to the prior art.
Figure 6:
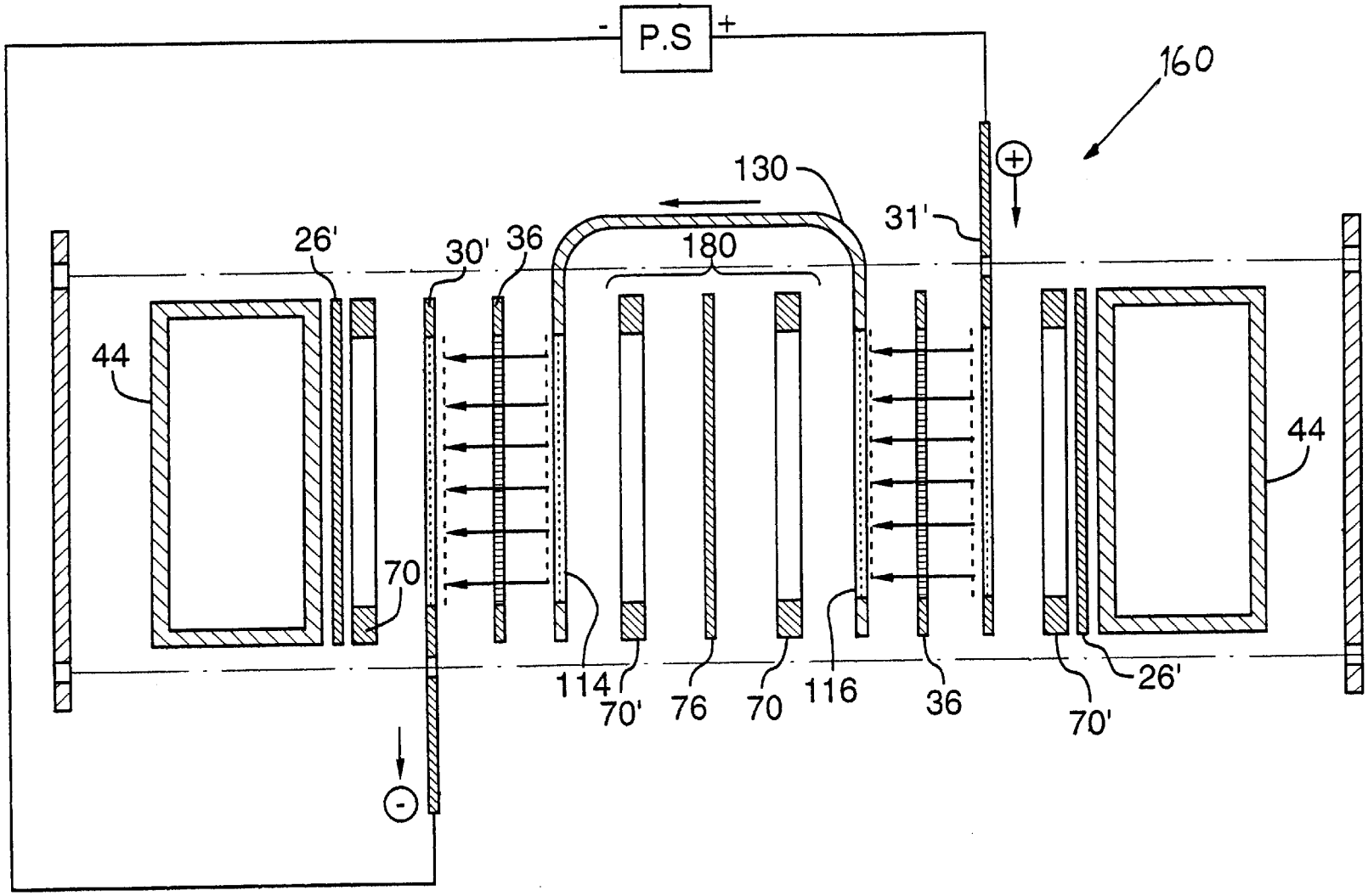
FIG.6 (Prior Art)
FIG. 6 is a horizontal cross-section along the line 6—6 of FIG. 5 showing the electrical current path through the single stack electrolyser cell block.

FIGS. 5 and 6 show a prior art configuration of an electrochemical system shown generally as 160 referred to as the single stack electrochemical system (SSE) configuration which is characterized by the fact that two or more cell compartments are placed one behind another to form a succession or "string", of cell compartments connected electrically in series. In the present invention the electrical connection between cells is made using a folded double electrode plate 130 so that current passes around the edge of insulating panel constituting an end wall 76. The anolyte frames 70 and catholyte frames 70' are identical to the corresponding electrolyte frames 38 and 40. Each cell is separated from adjacent cells by an electrolyte frame assembly 180 formed by sandwiching a liquid impermeable panel 76 between the two frames. External contact from the power supply (not shown) to the electrochemical system 160 is made to single plate electrodes 30'.

Electrochemical system 160 in FIGS. 5 and 6 comprises two cells having one double electrode plate 130 and two single plate electrodes 30' and 31' with one being located at each end of the stack. It will be understood that for a SSE with three cells, two double electrode plates 130 would be required, for an SSE with four cells, three double electrode plates would be required and so on. An insulating panel 26' is used at the ends of the stack adjacent to the end boxes 44.

With reference still to FIG. 5 anolyte frame 70, catholyte frame 70' and inter-cell panel 76 are sandwiched between the anode section 114 and cathode section 116 in the assembled electrolyser. Double electrode plate 130 is provided with two upper apertures 132 and two lower apertures 132'. A double apertured gasket 150 is positioned in each aperture 132 and 132' to separate the anode from cathode flow channels. Double electrode plate 130 is provided with apertures 134 which form a slot 136 in the folded plate to allow clearance for the tie rods (not shown) when the SSE is assembled as in FIG. 5 before being clamped.

Figure 7:
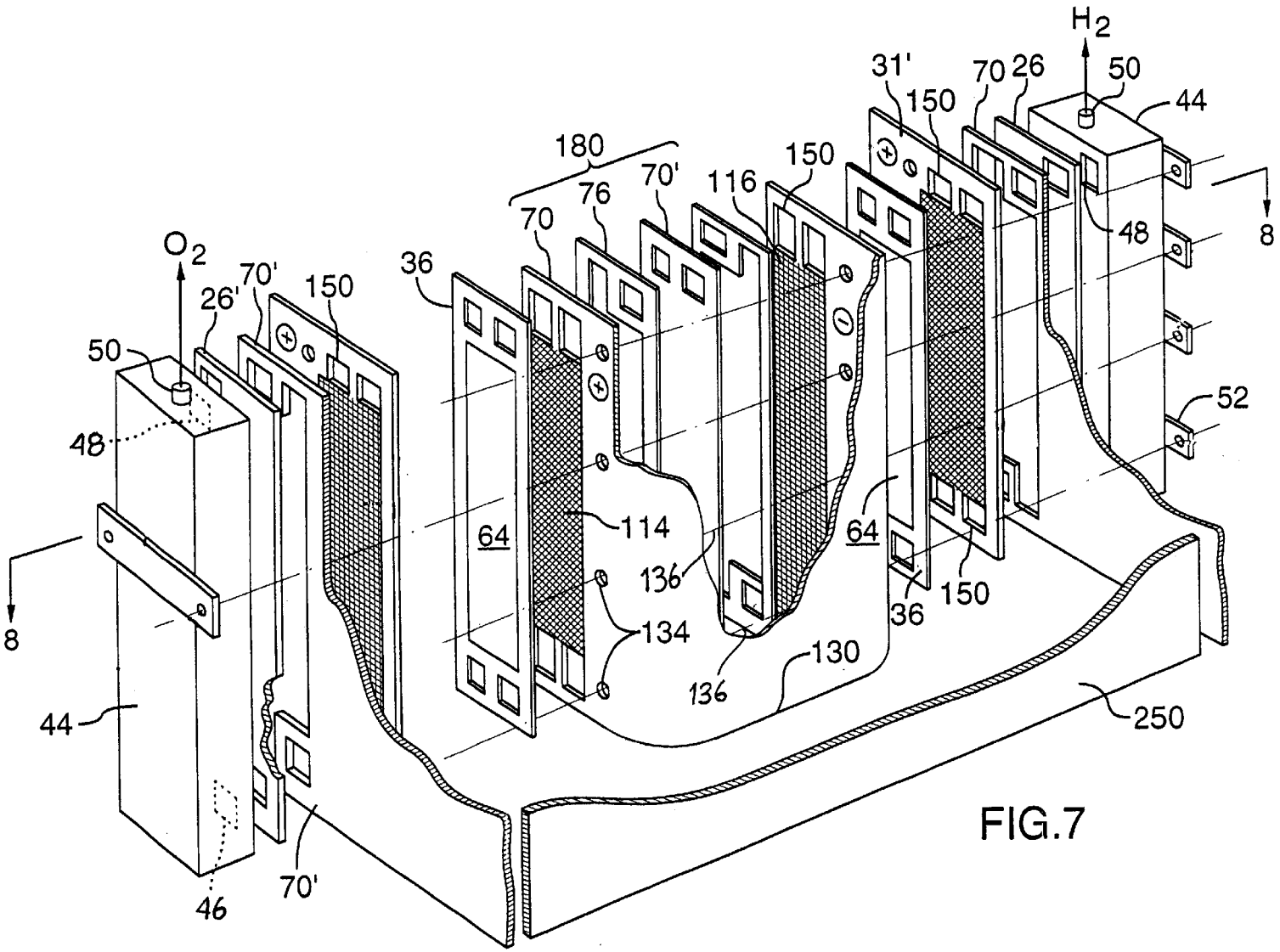
FIG. 7 is a perspective exploded view of a two cell single stack electrolyser (SSE) with a filler member according to the invention.
Figure 8:
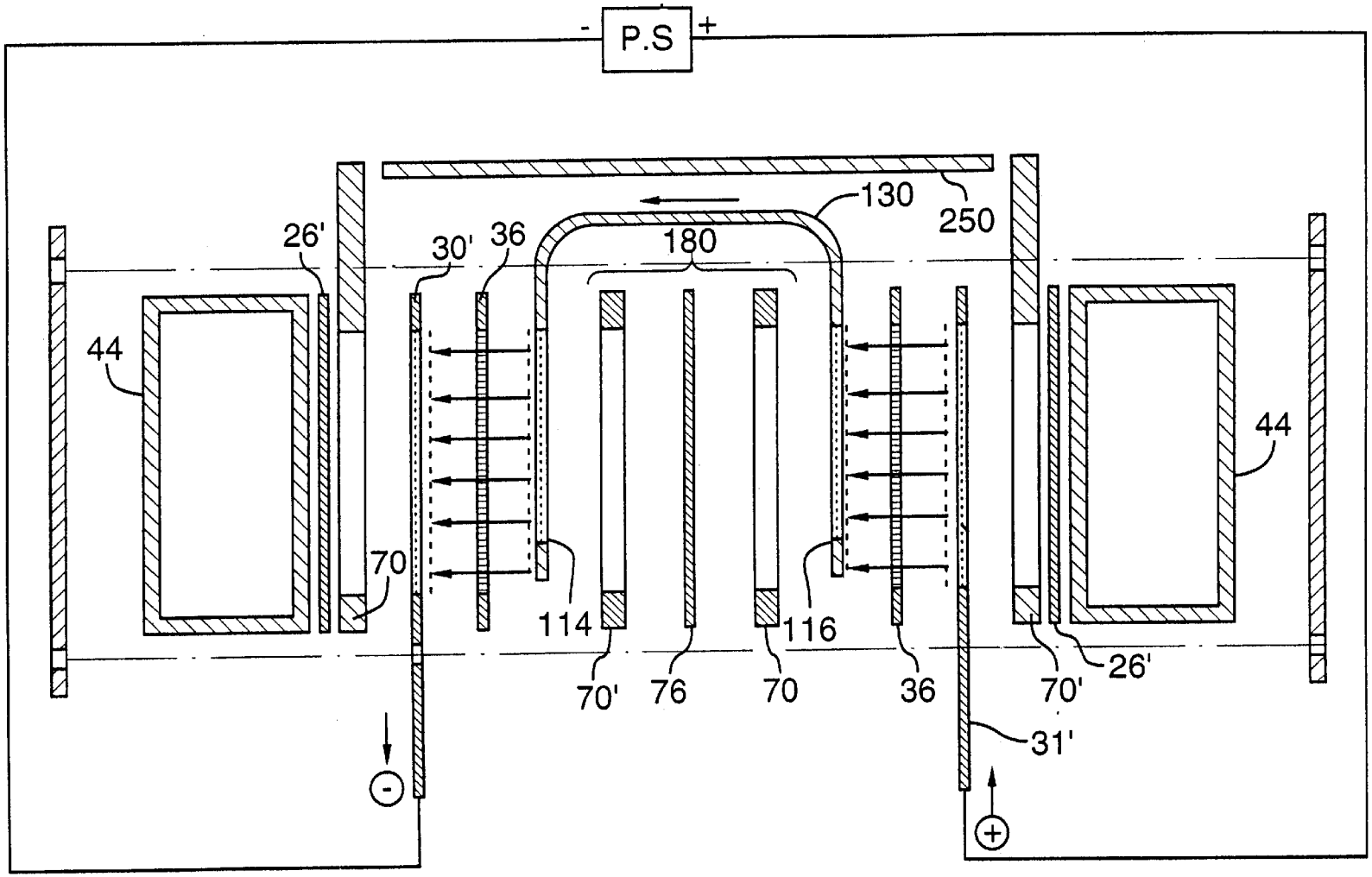
FIG. 8 is a horizontal cross-section along the line 8—8 of FIG. 7 showing the electrical current path through the single stack electrolyser cell block using a filler member according to the invention.

With reference now to FIGS. 7 and 8, according to the invention, it can be seen that the folded double electrode plate (DEP) 130 is shortened whereby the metallic terminus on the edge of the double electrode plate 130 does not interpose between separator assembly 36, more specifically the separator frame 62 (FIGS. 12*a* and 12*b*) thereof and the anolyte frame 70 and catholyte frame $\mathbf{70}^1$. Preferably, separator frame 62 is bonded to the circulation frames 70, $\mathbf{70}^1$ by means of an adhesive, solvent, ultrasonic or thermal bonding along with the end wall 76.

With further reference to FIGS. 7 and 8, it can be seen that encapsulation of the folded edge of the double electrode plate 130 can be accomplished by the relative extension of circulation frames 70, $\mathbf{70}^1$ with respect to the folded edge and the incorporation of a filter strip, 250, also made from a compressible elastomer.

Figure 9:
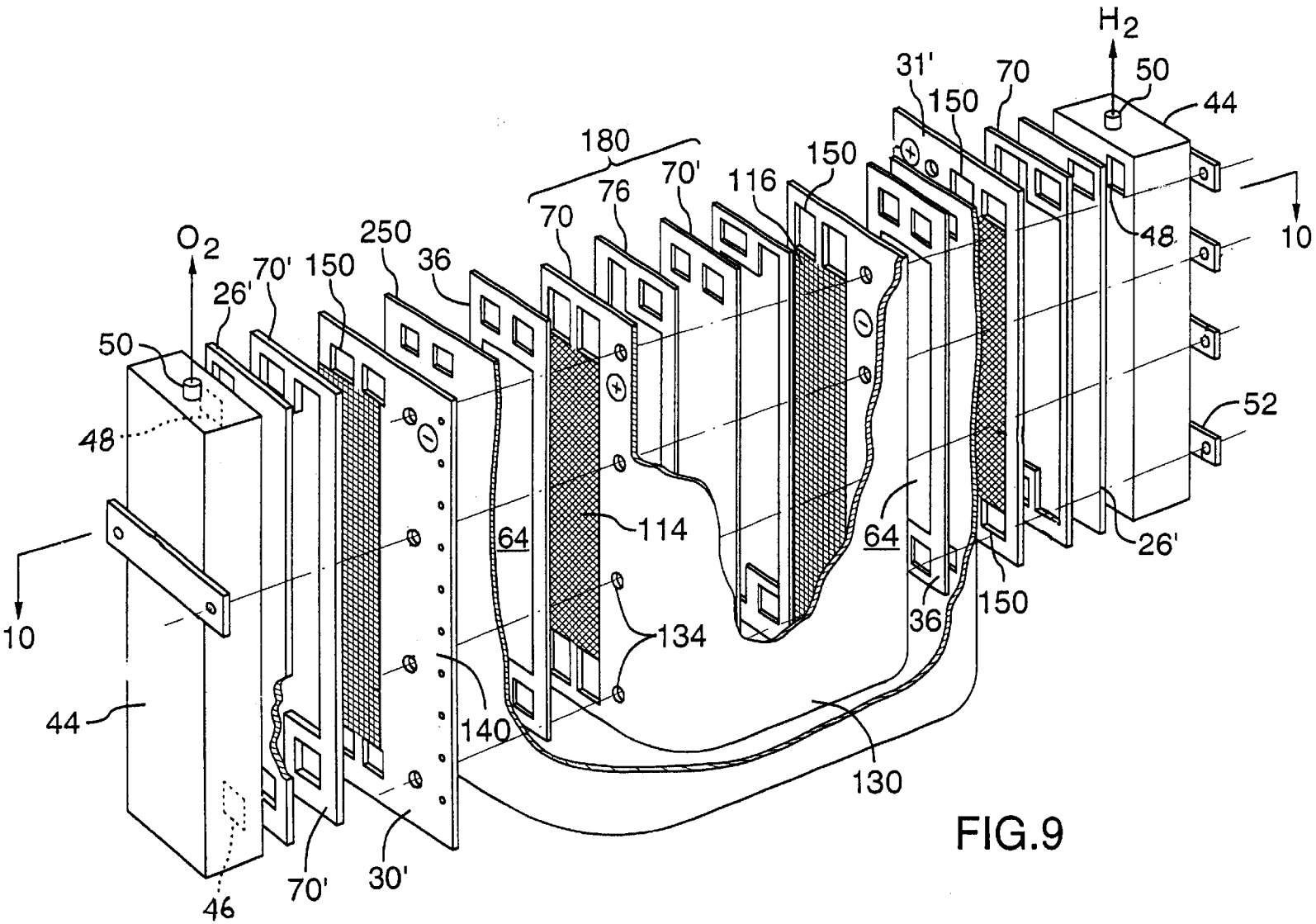
FIG. 9 is a perspective exploded view of a two cell single stack electrolyser with no filler member according to the invention.
Figure 10:
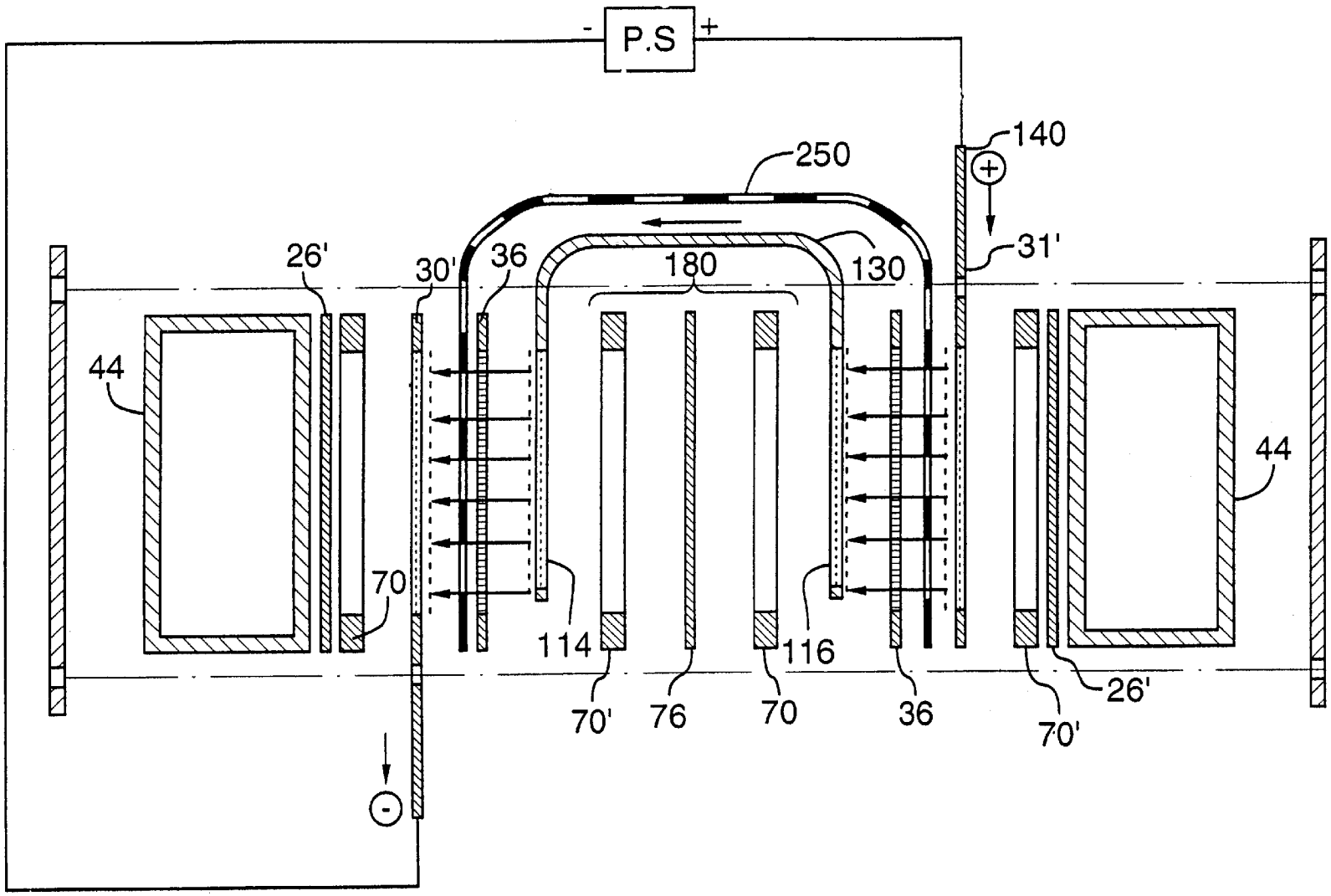
FIG. 10 is a horizontal cross-section along the line 10—10 of FIG. 9 showing the electrical current path through the single stack electrolyser cell block with no filler member according to the invention.

With reference now to FIGS. 9 and 10, according to the invention, it can be seen that the folded double electrode plate 130 is shortened whereby the metallic terminus on the edge of the DEP 130 does not interpose between separator assembly 36, —more specifically separator frame 62 FIGS. 12*a* and 12*b* thereof and anolyte frame 70 and catholyte frame $\mathbf{70}^1$.

With further reference to FIGS. 9 and 10, it can be seen that encapsulation of the folded edge of double electrode plate 130 can be accomplished by the relative extension of one of the separator frames 250 of the separator assembly fabricated from a compressible elastomer which replaces one of the separator frames 62 of prior art FIGS. 12*a* and 12*b*. Preferably, separator frame 62, circulation frames 70, $\mathbf{70}^1$, end wall 76 and encapsulation frame 250 are bonded one to another by means of adhesive, solvent, ultrasonic or thermal bonding.

Figure 11:
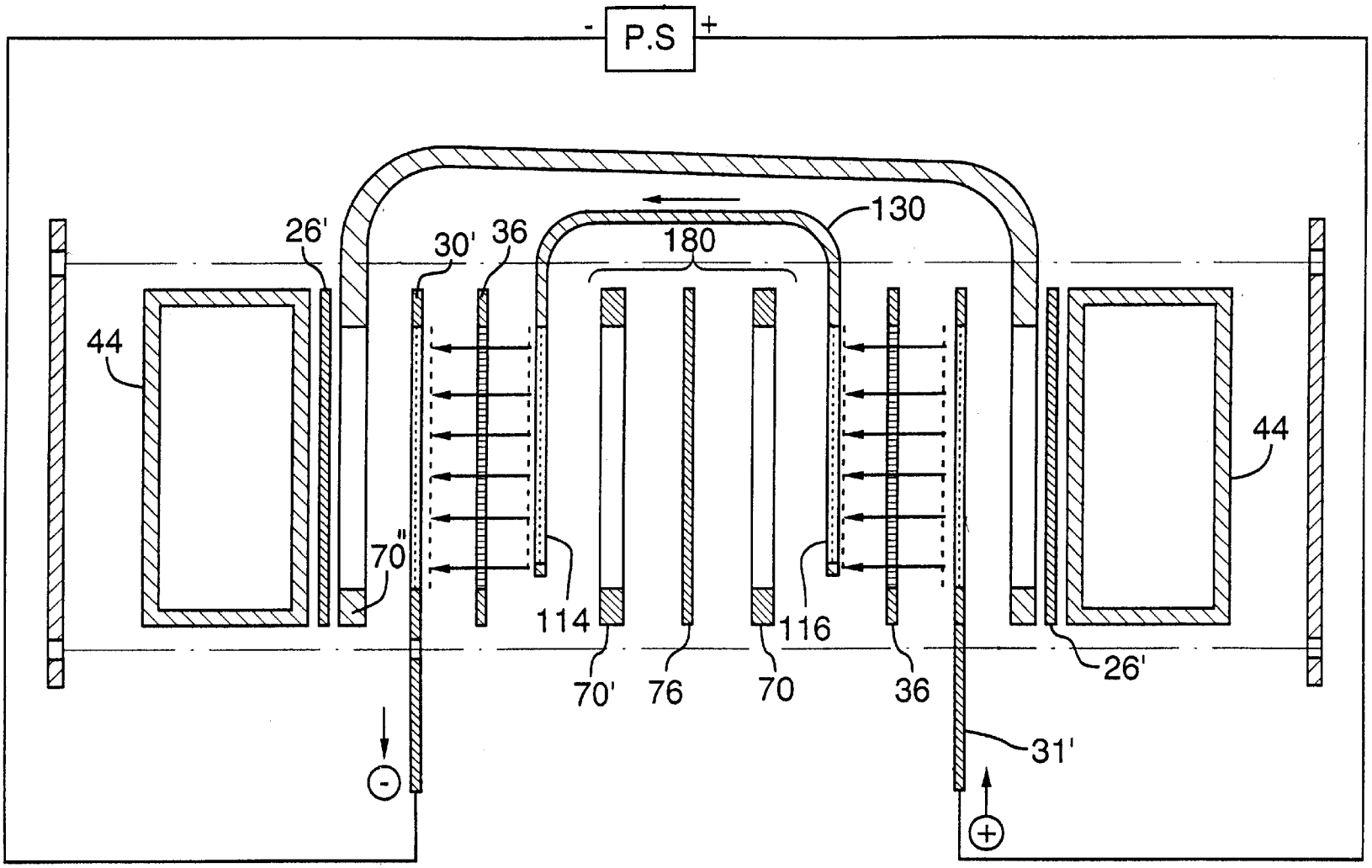
FIG. 11 is a horizontal cross-section showing the electrical current path through an alternative embodiment of a single stack electrolyser cell block with no filler member according to the invention.

With reference now to FIG. 11, according to the invention, it can be seen that the folded double electrode plate 130 is shortened whereby the metallic terminus on the edge of the double electrode plate 130 does not interpose between the separator assembly 36, —more specifically separator frame 62 FIGS. 12*a* and 12*b* thereof and the circulation frame 70. Circulation frame $\mathbf{70}^{11}$ is extended so as to encapsulate the folded edge of the double electrode plate and serves simultaneously as the anolyte frame 70 and catholyte frame $\mathbf{70}^1$ of the prior art according to FIGS. 5 and 6. Circulation frame $\mathbf{70}^{11}$ is fabricated from a compressible elastomer. Preferably, separator frame 62, circulation frame $\mathbf{70}^{11}$ and end wall 76 are bonded, one to another, by means of adhesive, solvent, ultrasonic or thermal bonding.

Although this disclosure has described and illustrated certain preferred embodiments of the invention, it is to be understood that the invention is not restricted to those particular embodiments. Rather, the invention includes all embodiments which are functional or mechanical equivalents of the specific embodiments and features that have been described and illustrated.

What is claimed is:

1. An improved electrochemical system, comprising (a) at least two cells, each cell defining an anolyte chamber and a catholyte chamber, and including at least an anode electrode adjacent to said anolyte chamber, and a cathode electrode adjacent to said catholyte chamber;

(b) at least one unitary one piece double electrode plate having an electrically conducting frame, the anode electrode in one of said at least two cells being supported on a first portion of said electrically conducting frame, and the cathode electrode in one of the other of said at least two cells being supported on a second portion of said electrically conducting frame spaced from said first portion;

(c) at least two single electrode plates, each single electrode plate including an electrically conducting frame for supporting an anode electrode or a cathode electrode wherein the first and second portions of the double electrode plate include at least opposed faces, each of the opposed faces including a substantially planar peripheral surface extending about a periphery of the supported anode and cathode electrodes, and wherein the electrically conducting frame of the single electrode plate includes opposed faces and a planar peripheral surface on each of the opposed faces extending about a periphery of the anode or cathode supported on the single electrode plate;

(d) a separator between the catholyte and anolyte chambers and having at least a peripheral frame formed of a compressible elastomer;

(e) an anolyte chamber forming frame formed of a compressible elastomer and a catholyte chamber forming frame member formed of a compressible elastomer within each cell, wherein said anolyte and catholyte chamber forming frame members and the peripheral frame of the separator are compressed to form fluid tight seals when said electrochemical system is assembled, the improvement wherein said anolyte and catholyte chamber forming frame members extend beyond edges of said electronically conducting frames to allow of said peripheral frame being bonded in direct abutment with said anolyte and catholyte chamber forming frame members.

2. An electrochemical system according to claim 1 wherein (a) said electrically conducting frame of the double electrode plate includes at least a length and a width, (b) said peripheral frame having at least a length and a width, and (c) each of said anolyte and catholyte chamber forming frame members having at least a length and a width; and wherein said length and width of said electrically conducting frame is smaller than said lengths and widths of said peripheral frame and said anolyte and catholyte chamber forming frame members.

3. An electrochemical system according to claim 1 wherein there are n cells arranged sequentially in a single stack wherein n is an integer number of cells greater than or equal to 2 with two cells at opposed ends of said stack, wherein the electrolyser includes at least n−1 double electrode plates and two single electrode plates, wherein one of the single electrode plates supports an anode electrode and is located in the cell at one end of said stack and the other single electrode plate supports a cathode electrode and is located in said cell at the other end of said stack, and wherein each double electrode plate has said first portion located in one cell and said second portion located in an adjacent cell in said stack, and including an insulating panel sandwiched between the first and second portion of each double electrode plate.

4. An electrochemical system according to claim 3 wherein said electrically conducting frames of the double electrode plate and the single electrode plates each include at least a length and a width, said length being greater than said width, and wherein said anode and cathode electrodes supported on said single electrode plate and said double electrode plate each have a length and a width, said length being greater than said width.

5. An electrochemical system according to claim 4 wherein said double electrode plates are folded down a middle portion thereof so the anode electrode supported by the first portion of the electrically conducting frame is in opposing relationship to the cathode attached to said second portion of the electrically conducting frame in said adjacent cell.

6. An electrochemical system according to claim 1 wherein said electrochemical system is a multi-stack electrolyser including at least a plurality of cell stacks with opposed first and second outer cell stacks, said cell stacks being arranged substantially in parallel defining a plurality of rows of cells, wherein the cells in each stack defines a column of cells, and wherein cells in a particular row are spaced from adjacent cells in said row.

7. An electrochemical system according to claim 1 wherein said peripheral frame and said anolyte and catholyte chamber forming frame members are bonded by bonding means selected from the group consisting of thermal, ultrasonic, solvating and adhesion.

* * * * *